US006650321B1

(12) United States Patent
Lee

(10) Patent No.: US 6,650,321 B1
(45) Date of Patent: Nov. 18, 2003

(54) CONTROLLING AN IMAGE ON MULTI-SYNCHRONIZATION MODE DISPLAY

(75) Inventor: Ji-Young Lee, Kyungki-do (KR)

(73) Assignee: SamSung Electronics Co., Ltd., Suwon (KR)

( * ) Notice: Subject to any disclaimer, the term of this patent is extended or adjusted under 35 U.S.C. 154(b) by 582 days.

(21) Appl. No.: 09/086,312

(22) Filed: May 27, 1998

(30) Foreign Application Priority Data

May 27, 1997 (KR) ..... 97-20945

(51) Int. Cl.[7] ..... G09G 5/00
(52) U.S. Cl. ..... 345/204
(58) Field of Search ..... 345/112, 118, 345/121, 127, 132, 10–14, 18, 20, 27, 211–213, 660, 698

(56) References Cited

U.S. PATENT DOCUMENTS 5,579,029 A * 11/1996 Arai et al. ..... 345/132
5,963,266 A * 10/1999 Fujimori ..... 348/511
5,986,636 A * 11/1999 Wu ..... 345/132
6,011,592 A * 1/2000 Vaughan et al. ..... 348/552

* cited by examiner

*Primary Examiner*—Richard Hjerpe
*Assistant Examiner*—Alexander Eisen
(74) *Attorney, Agent, or Firm*—Robert E. Bushnell, Esq.

(57) ABSTRACT

Data for controlling the size of an image is stored in a memory when a multi-synchronization mode display is fabricated, and the image is automatically controlled using the stored data. A technique for controlling an image on the multi-synchronization display, includes: confirming if there is an input from a user for controlling the image; setting a variable range of a reference value determined when the display was fabricated, when it is confirmed that there is no input from the user; when the variable range is set, confirming if the user has operated an up-control/down-control key for controlling the image; and when it is confirmed that the user has operated the up-control/down-control key, increasing/decreasing data according to the up-control/down-control operation of the user.

8 Claims, 3 Drawing Sheets

CONTROLLING AN IMAGE ON MULTI-SYNCHRONIZATION MODE DISPLAY

CLAIM OF PRIORITY

This application makes reference to, incorporates the same herein, and claims all benefits accruing under 35 U.S.C. §119 from an application for METHOD OF CONTROLLING IMAGE ON MULTI-SYNCHRONIZATION MODE DISPLAY DEVICE earlier filed in the Korean Industrial Property Office on the $27^{th}$ of May 1997 and there duly assigned Ser. No. 20945

BACKGROUND OF THE INVENTION

1. Field of the Invention

The present invention relates to a technique for controlling an image on a multi-synchronization mode display, more specifically, to a technique for controlling an image on a multi-synchronization mode display, in which data for controlling the size of an image is stored in a memory when the display is fabricated, and the image is automatically controlled using the stored data.

2. Discussion of Related Art

Recently, a video card has been developed to generate various modes in a single synchronous frequency mode. This is for the purpose of allowing a user to be able to see a result processed by a personal computer (PC) main body through a display in various modes. With a multi-synchronization mode display, an image displayed thereon is variable according to the synchronization mode. In other words, the horizontal/vertical position value and horizontal/vertical size value of an image displayed on the multi-synchronization mode display vary with the synchronization mode. Thus, the multi-synchronization mode display sets a reference value according to a specific mode to correspond to each synchronization mode and stores it. An example of the image control reference value for each corresponding mode is shown in the following Table 1.

TABLE 1

| Mode | H-position | V-position | H-size | V-size |
|---|---|---|---|---|
| Mode 1 | 4.8 V | 3.2 V | 2 V | 3.2 V |
| Mode 2 | 3.2 V | 2.7 V | 4.5 V | 2.8 V |
| Mode 3 | 2.9 V | 3.7 V | 3 V | 3.7 V |

As shown in Table 1, the horizontal and vertical positions and horizontal and vertical sizes according to image control by mode are set in order to perform image control suitable for each mode when the display is fabricated. However, in such displays, the image control is not correctly carried out due to errors in the fabrication of its cathode ray tube. To solve this problem, the reference value is allowed to be varied in a predetermined range, this range being narrow in such a display.

SUMMARY OF THE INVENTION

Accordingly, the present invention is directed to a technique for controlling an image on a multi-synchronization mode display that substantially obviates one or more of the problems due to the limitations and disadvantages of the related art.

An object of the present invention is to provide a method of controlling an image on a multi-synchronization mode display, in which a variable range of an image according to each mode is controlled with software.

Another object of the present invention is to provide a method of controlling an image on a multi-synchronization mode display, which prevents the display from being damaged when the variable range of an image according to a mode exceeds the maximum value.

Still another object of the present invention is to provide a method of controlling an image on a multi-synchronization mode display, in which the variable range of an image according to each mode is controlled with software, to prevent the need for a separate circuit for controlling the variable range to be added to the display, thereby reducing the fabrication cost of the display.

To accomplish the objects of the present invention, there is provided a method of controlling an image on a multi-synchronization display, including the steps of: confirming if there is an input from a user for controlling the image; setting a variable range of a reference value determined when the display is fabricated, upon it being confirmed that there is no input from a user; upon the variable range being set, confirming if the user has operated an up-control/down-control key for controlling the image; and upon it being confirmed that the user has operated the up-control/down-control key, increasing/decreasing data according to the up-control/down-control operation of the user.

It is to be understood that both the foregoing general description and the following detailed description are exemplary and explanatory and are intended to provide further explanation of the invention as claimed.

BRIEF DESCRIPTION OF THE ATTACHED DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF PREFERRED EMBODIMENT

Reference will now be made in detail to the preferred embodiments of the present invention, examples of which are illustrated in the accompanying drawings.

Figure 1:
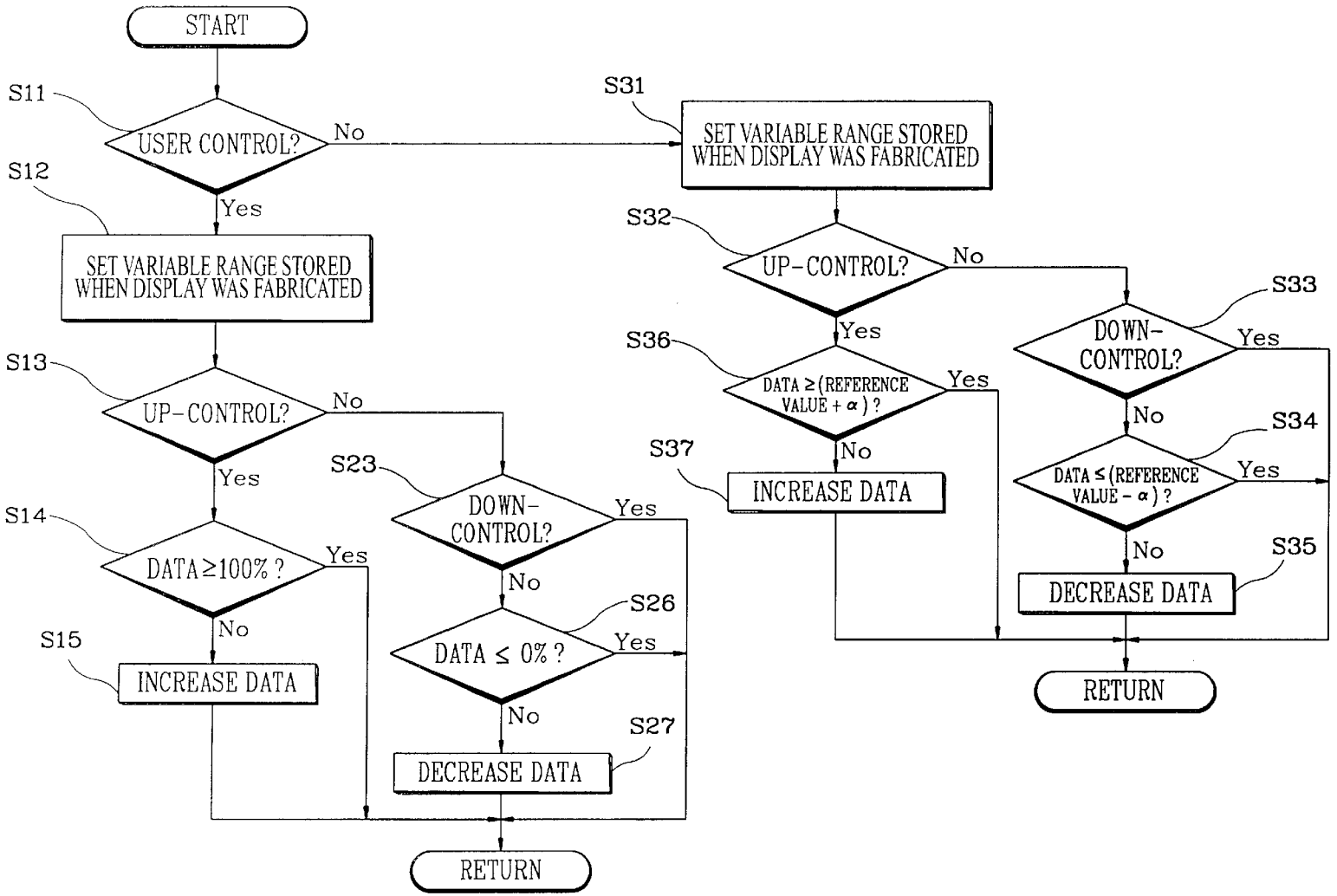
FIG. 1 is a flowchart showing a method of controlling images on a display according to the present invention.
Figure 2:
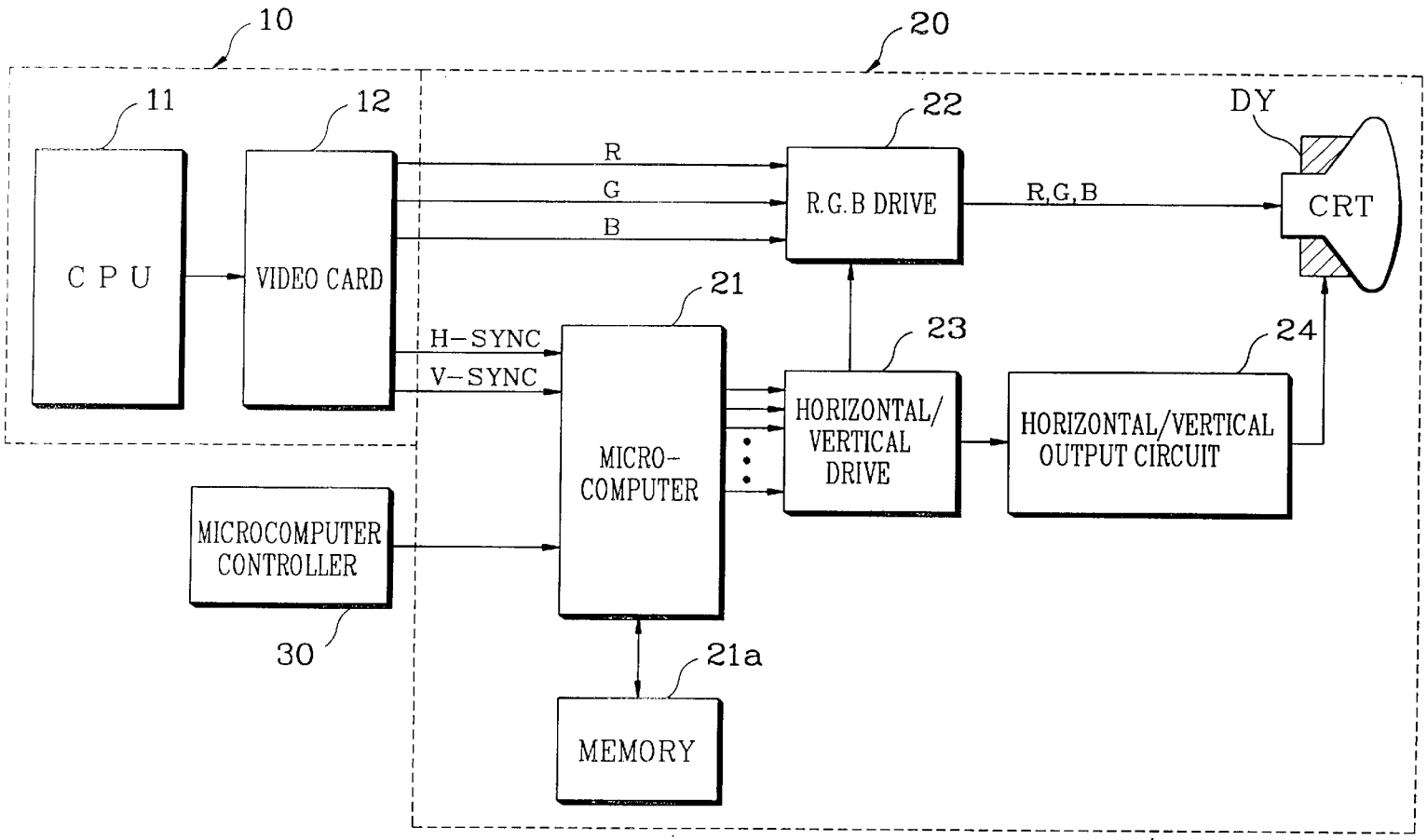
FIG. 2 is a block diagram showing a display to which the image controlling method of the present invention is applied.

Referring to FIGS. 1 and 2, the method of controlling an image on a multi-synchronization mode display according to the present invention comprises: a step S11 of confirming if there is an input from a user for controlling the image, a step S31 of setting a variable range of a reference value determined when the display was fabricated when there is no input in step S11; steps S32 and S33 of confirming if the user controls moving the image up or down when the variable range is set in step S21, and steps S34, S35, S36 and S37 of increasing or decreasing data, when it is confirmed that the user controls moving the image up or down in steps S32 and S33, according to the confirmation result.

The method of controlling images on the display according to the present invention is explained below in detail. As shown in FIG. 2, a video card 12 receives data processed by a CPU of a PC main body 10 and processes it, to generate a video signal (R,G,B). The video card 12 also generates horizontal and vertical synchronous signals H-SYNC and V-SYNC for synchronizing the video signal. The horizontal and vertical synchronous signals are supplied to a microcomputer 21 of a display 20. The horizontal and vertical synchronous signals vary with the manufacturers of video cards. The reference value stored in a memory 21 a in a factory mode is read according to the horizontal and vertical synchronous signals generated by the video card 12, to display the video signal (R,G,B). The reference value is controlled by a microcomputer controller 30 when the display is fabricated.

On reception of the horizontal and vertical synchronous signals from the video card 12, the microcomputer 21 judges the mode of the received horizontal and vertical synchronous signals. Then, it reads the reference value according to image control suitable for the mode from a memory 21*a* and sends it to a horizontal/vertical drive 23. The horizontal/vertical drive 23 receives the reference value and drives a horizontal/vertical output circuit 24, generating a horizontal sawtooth wave current and a vertical sawtooth wave current which are input to a deflection yoke DY. The horizontal sawtooth wave current and vertical sawtooth wave current sufficiently interact with the video signal received from video card 12 by an R,G,B drive 22, determining the scanning cycle of the video signal supplied to a CRT.

The user confirms an image displayed on the CRT, and then determines whether or not to control it (S11). The user confirms if the image displayed on the CRT is suitable for the corresponding mode. When the user does not control the image, the microcomputer 21 sets the variable range of the reference value stored in the memory 21*a* during the factory mode when the display was fabricated (S31). The variable range (0 to 100%) is set to be processed in three bits, being controllable in 256 stages. Upon setting of the variable range, the microcomputer 21 confirms if the user has operated an up-control key or down-control key (not shown) in order to control the image (S32 and S33). When it is confirmed that the user has operated the up-control or down-control key, the microcomputer 21 increases or decreases data according to the confirmation result (S34, S35, S36 and S37).

When it is confirmed that the user has operated the up-control key (S13), the microcomputer 21 judges if up-controlled data is larger than or equal to the maximum value (100%) of the set variable range (S14). When it is not, the microcomputer 21 increases data according to the controlled data (S17). When it is confirmed that the user has operated the down-control key (S23), the microcomputer 21 judges if down-controlled data is less than or equal to the minimum value (0%) of the set variable range (S26) and, when it is not, the microcomputer decreases data according to the controlled data (S27). That is, the variable range which can be controlled by the user is set to 0 to 100%, and it is adjusted in 256 stages, thereby controlling images more minutely.

Figure 3:
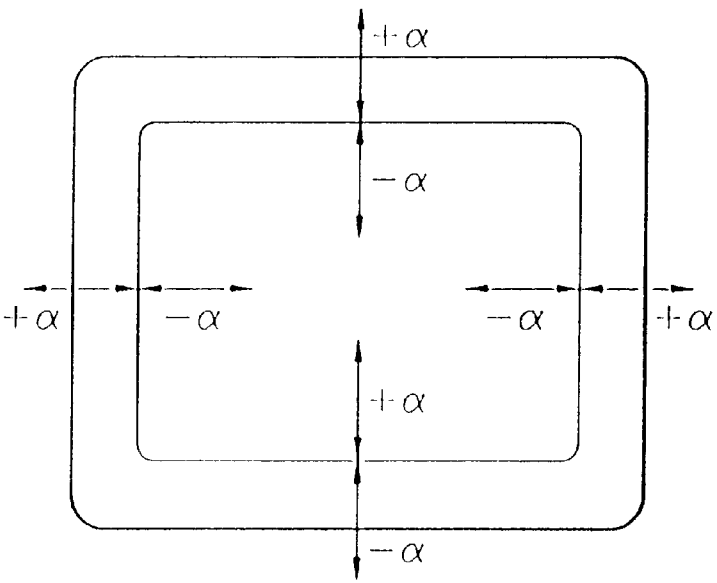
FIG. 3 is a diagram showing a variable range when an image is controlled, according to the present invention.

In order to reduce damage to the multi-synchronization display, due to the excessive control of an image displayed thereon by the user, the microcomputer 21, first of all, confirms if the user has used the control key for controlling the image (S11). When he does, the microcomputer 21 reads the reference value stored in the memory 21*a* when the display was fabricated (S31). Then, the microcomputer 21 confirms whether or not the user has operated one of the up-control key or down-control key (S32 or S33). When it is confirmed that the user has operated the keys, the microcomputer 21 compares data controlled according to the up-control or down-control with the minimum or maximum value (reference value±α) (S36 or S34), and increases or decreases the data depending on the comparison result (S37 and S35). The value α is set as shown in FIG. 3.

Specifically, when the microcomputer 21 recognizes that the user has operated the down-control key (S33), it judges if controlled data is less than or equal to the minimum value for image control (reference value−α) (S34) and, when it is not, decreases data according to the controlled data (S35). On the other hand, when the user has operated the up-control key (S32), the microcomputer 21 judges if the controlled data is greater than or equal to the maximum value for image control (reference value+α) (S36) and, when it is not, increases data according to the controlled data (S37). It is preferable that α is 5. That is, 5 is added to or subtracted from the reference value which is adjusted when the display is fabricated, based on the center of the display picture. Accordingly, the variable range can be set by adding or subtracting the values to or from the reference value which is determined when the display was fabricated. An example is shown in the following Table 2.

TABLE 2

| Data fixed during fabrication | Down-control by user | Up-control by user |
|---|---|---|
| H-position: 2.8 V | Minimum: 2.3 V | Maximum: 3.3 V |
| H-size: 1.7 V | Minimum: 1.2 V | Maximum: 2.2 V |
| V-position: 3.2 V | Minimum: 3.2 V | Maximum: 3.7 V |
| V-size: 4.0 V | Minimum: 3.5 V | Maximum: 4.5 V |

As described above, the present invention is able to minutely set the variable range such as horizontal and vertical sizes, horizontal and vertical positions or geometric distortion, and set the value α to prevent the display from being damaged due to excessive control of an image by the user.

It will be apparent to those skilled in the art that various modifications and variations can be made in the method of controlling images on a multi-synchronization mode display of the present invention without departing from the spirit or scope of the invention. Thus, it is intended that the present invention cover the modifications and variations of this invention provided they come within the scope of the appended claims and their equivalents.

What is claimed is:

1. A method of controlling an image parameter of an image displayed on a multi-synchronization display, said image parameter being one of increase vertical size of image, decrease vertical size of image, increase horizontal size of image, decrease horizontal size of image, move image up, move image down, move image to right, and move image to left, said method comprising the steps of:

(a) determining whether there is an image parameter input from a user for controlling an image parameter of the image;

(b) setting a variable range of a reference value determined when the display was fabricated, upon it being determined that there is no image parameter input from the user;

(c) upon the variable range being set, determining whether the user has operated a control key for changing an image parameter of the displayed image; and (d) upon it being determined that the user has operated the control key, increasing or decreasing image parameter data according to the image parameter input by the user;

wherein all of said determining steps are carried out entirely by software means in a programmed microcomputer; and wherein the step (d) of increasing or decreasing image parameter data comprises the steps of:

(d1) upon it being determined that the user has operated the control key for increasing the image parameter data, determining whether the increased image parameter data is greater than or equal to a predetermined maximum value of the variable range;

(d2) if the increased image parameter data is not greater than or equal to the predetermined maximum value of the variable range, increasing the image parameter data according to the image parameter input from the user;

(d3) upon it being determined that the user has operated the control key for decreasing the image parameter data, determining whether the decreased image parameter data is less than or equal to a predetermined minimum value of the variable range; and (d4) if the decreased image parameter data is not less than or equal to the predetermined minimum value of the variable range, decreasing the image parameter data according to the image parameter input from the user.

2. The method of claim 1, wherein the variable range is set to one of 256 values.

3. A method of controlling an image parameter of an image displayed on a multi-synchronization display, said image parameter being one of increase vertical size of image, decrease vertical size of image, increase horizontal size of image, decrease horizontal size of image, move image up, move image down, move image to right, and move image to left, said method comprising the steps of:

(a) determining whether there is an image parameter input from a user for controlling an image parameter of the image;

(b) setting a variable range of a reference value determined when the display was fabricated, upon it being determined that there is no image parameter input from the user;

(c) upon the variable range being set, determining whether the user has operated a control key for changing an image parameter of the displayed image; and (d) upon it being determined that the user has operated the control key, increasing or decreasing image parameter data according to the image parameter input by the user;

wherein all of said determining steps are carried out entirely by software means in a programmed microcomputer; and wherein the step (a) of determining whether there is an image parameter input from the user comprises the steps of:

(a1) reading the reference value;

(a2) determining whether the user has operated the control key; and (a3) upon it being determined that the user has operated the control key, comparing the image parameter input from the user with predetermined minimum and maximum values for the image parameter, and selectively increasing or decreasing the image parameter input according to the comparison result.

4. The method of claim 3, wherein the step (d) of increasing or decreasing the image parameter data comprises the steps of:

(d1) upon it being determined that the user has operated the control key to decrease the image parameter data, determining whether the decreased image parameter data is less than or equal to a predetermined minimum value of the variable range;

(d2) decreasing the image parameter data according to the image parameter input from the user upon the decreased image parameter data being not less than or equal to the predetermined minimum value;

(d3) upon it being determined that the user has operated the control key to increase the image parameter data, determining whether the increased image parameter data is greater than or equal to a predetermined maximum value; and (d4) increasing the image parameter data according to the image parameter input from the user upon the increased image parameter data being not greater than or equal to the predetermined maximum value.

5. An apparatus for controlling an image parameter of an image displayed on a multi-synchronization display, said image parameter being one of increase vertical size of image, decrease vertical size of image, increase horizontal size of image, decrease horizontal size of image, move image up, move image down, move image to right, and move image to left, said apparatus comprising:

input determining means for determining whether a user has provided an image parameter input for controlling an image parameter of the image;

setting means for setting a variable range of a reference value determined when the display was fabricated, upon it being determined by said input determining means that the user has not provided an image parameter input;

control means for determining whether the user has operated a control key for providing an input to increase or decrease an image parameter, upon the variable range being set by the setting means; and means for increasing or decreasing image parameter data according to the image parameter input by the user, upon it being determined by the control means that the user has provided the input to increase or decrease the image parameter by using the control key;

wherein said input determining means and said control means carry out software-controlled operations in a programmed microcomputer, and operate without recourse to hard-wired logic apparatus; and wherein the means for increasing or decreasing the image parameter data comprises:

means for determining whether the increased image parameter data is greater than or equal to a predetermined maximum value of the variable range upon it being determined that the user has operated the control key to provide an input to increase the image parameter data;

means for increasing the image parameter data according to the image parameter input from the user upon it being determined that the increased image parameter data is not greater than or equal to the predetermined maximum value of the variable range;

means for determining whether the decreased image parameter data is less than or equal to a predetermined minimum value of the variable range upon it being determined that the user has operated the control key to provide an input to decrease the image parameter data; and means for decreasing the image parameter data according to the image parameter input from the user upon it being determined that the decreased image parameter data is not less than or equal to the predetermined minimum value of the variable range.

6. The apparatus of claim 5, wherein the variable range of the setting means is set to one of 256 values.

7. An apparatus for controlling an image parameter of an image displayed on a multi-synchronization display, said image parameter being one of increase vertical size of image, decrease vertical size of image, increase horizontal size of image, decrease horizontal size of image, move image up, move image down, move image to right, and move image to left, said apparatus comprising:

input determining means for determining whether a user has provided an image parameter input for controlling an image parameter of the image;

setting means for setting a variable range of a reference value determined when the display was fabricated, upon it being determined by said input determining means that the user has not provided an image parameter input;

control means for determining whether the user has operated a control key for providing an input to increase or decrease an image parameter, upon the variable range being set by the setting means; and means for increasing or decreasing image parameter data according to the image parameter input by the user, upon it being determined by the control means that the user has provided the input to increase or decrease the image parameter by using the control key;

wherein said input determining means and said control means carry out software-controlled operations in a programmed microcomputer, and operate without recourse to hard-wired logic apparatus; and wherein the input determining means for determining whether the user has provided an image parameter input comprises:

means for reading the reference value;

means for determining whether the user has operated the control key to provide the image parameter input for controlling the image parameter; and comparing means for comparing the image parameter input from the user with a minimum and a maximum value for image control upon it being confirmed that the user has operated the control key to provide the image parameter input, and for selectively increasing or decreasing the image parameter input according to the comparison result.

8. The apparatus of claim 7, wherein the means for increasing or decreasing the image parameter data comprises:

means for determining whether the decreased image parameter data is less than or equal to a predetermined minimum value upon it being determined that the user has operated the control key to decrease the image parameter data;

means for decreasing the image parameter data according to the image parameter input from the user upon it being determined that the decreased image parameter data is not less than or equal to the predetermined minimum value;

means for determining whether the increased image parameter data is greater than or equal to a predetermined maximum value upon it being determined that the user has operated the control key to increase the image parameter data; and means for increasing the image parameter data according to the image parameter input from the user upon it being determined that the image parameter data is not greater than or equal to the predetermined maximum value.

* * * * *